US010173823B2

(12) United States Patent
Cibert et al.

(10) Patent No.: US 10,173,823 B2
(45) Date of Patent: Jan. 8, 2019

(54) PACKAGING SUITABLE FOR AT LEAST ONE HEAVY OBJECT

(71) Applicant: DEVIALET, Paris (FR)

(72) Inventors: Grégory Cibert, Paris (FR); Emmanuel Nardin, Paris (FR); Quentin Sannié, Paris (FR)

(73) Assignee: DEVIALET, Paris (FR)

( * ) Notice: Subject to any disclaimer, the term of this patent is extended or adjusted under 35 U.S.C. 154(b) by 42 days.

(21) Appl. No.: 15/322,377

(22) PCT Filed: Jun. 24, 2015

(86) PCT No.: PCT/EP2015/064293
§ 371 (c)(1),
(2) Date: Feb. 13, 2017

(87) PCT Pub. No.: WO2151/197716
PCT Pub. Date: Dec. 30, 2015

(65) Prior Publication Data

US 2017/0203904 A1 Jul. 20, 2017

(30) Foreign Application Priority Data

Jun. 25, 2014 (FR) ..... 14 55923

(51) Int. Cl.
*B65D 81/113* (2006.01)
*B65D 5/50* (2006.01)
*B65D 85/68* (2006.01)

(52) U.S. Cl.
CPC ..... *B65D 81/113* (2013.01); *B65D 5/509* (2013.01); *B65D 85/68* (2013.01); *B65D 2585/684* (2013.01)

(58) Field of Classification Search
CPC ..... B65D 81/113; B65D 85/30; B65D 85/68; B65D 2585/684; B65D 5/50; B65D 5/509
(Continued)

(56) References Cited

U.S. PATENT DOCUMENTS 3,048,267 A * 8/1962 Starzec ..... B65D 81/113 206/523
3,344,973 A * 10/1967 Studen ..... B65D 5/563 206/523

(Continued)

FOREIGN PATENT DOCUMENTS

DE 2348869 A1 4/1975
DE 2603434 A1 * 8/1977 ..... B65D 81/113

(Continued)

OTHER PUBLICATIONS

PCT International Search Report dated Jul. 31, 2015 issued in corresponding PCT International Application No. PCT/EP2015/064293.

(Continued)

*Primary Examiner* — Bryon Gehman
(74) *Attorney, Agent, or Firm* — Troutman Sanders LLP

(57) ABSTRACT

Packaging for an object, preferably having a mass between 2 and 25 kg, comprising a body having at least two parts movable between a closed configuration defining a housing to receive the object, and an open configuration, in which the two parts are separated from one another to allow the object to be removed. The body defining, when closed, a lower face intended to rest on a surface in a bearing direction; and a member fixing the two parts together. The body also comprises a base supporting the object when open, the base defining at least one portion of the lower face of the body when closed. At least one of said parts of the body is situated away from the base when open to arrange direct access to the object in at least one access direction substantially perpendicular to the bearing direction allowing removal of the object.

17 Claims, 3 Drawing Sheets

(58) Field of Classification Search
USPC ..... 206/320, 523; 220/4.21
See application file for complete search history.

(56) References Cited

U.S. PATENT DOCUMENTS

| | | | | | |
|---|---|---|---|---|---|
| 3,414,121 | A * | 12/1968 | Hiroshi | B65D 81/113 | 206/320 |
| 3,416,648 | A * | 12/1968 | Levi | B65D 81/113 | 206/523 |
| 4,173,286 | A * | 11/1979 | Stanko | B65D 81/022 | 206/523 |
| 4,828,115 | A * | 5/1989 | Wiegand | B65D 81/113 | 206/320 |
| 5,156,277 | A | 10/1992 | Witz | | |
| 2013/0100359 | A1* | 4/2013 | Yokawa | B65D 81/113 | 206/320 |

FOREIGN PATENT DOCUMENTS

| | | | | |
|---|---|---|---|---|
| DE | 2805746 | A1 * | 8/1978 | B65D 85/30 |
| DE | 8327122 | U1 | 11/1983 | |
| EP | 0455593 | A1 | 11/1991 | |
| FR | 1225812 | A | 7/1960 | |
| FR | 2309427 | A1 | 11/1976 | |
| FR | 2863251 | A1 | 6/2005 | |

OTHER PUBLICATIONS

French Search Report dated Mar. 19, 2015 issued in corresponding French Application No. 1455923.

Translation of the Written Opinion of the International Searching Authority issued in corresponding PCT International Application No. PCT/EP2015/064293.

* cited by examiner

PACKAGING SUITABLE FOR AT LEAST ONE HEAVY OBJECT

CROSS-REFERENCE TO RELATED APPLICATIONS

This application is a National Stage of International Application No. PCT/EP2015/064293, filed Jun. 24, 2015. This application, in turn, claims priority to French Patent Application No. 1455923, filed Jun. 25, 2014. Both applications are incorporated herein by reference.

FIELD OF THE INVENTION

The present invention relates to a packaging suitable for at least one object preferably having a mass comprised between 2 and 25 kg, the packaging comprising:

- a body having at least two parts, which is able to be moved between a closed configuration, in which the body defines a housing suitable for receiving the object, and an open configuration, in which the two parts are separated from one another relative to the closed configuration to allow the object to be removed from said housing, the body defining, in the closed configuration, a lower face intended to rest on the surface in a bearing direction; and
- a member for fixing the two parts together in the closed configuration.

The object is for example a speaker enclosure or an electroacoustic amplifier.

The invention also relates to an assembly of such an object and such packaging.

BACKGROUND

An object such as a speaker enclosure or an amplifier for example typically has a mass comprised between 2 and 25 kg. To package such an object, it is known to place it in a carton or box opening upward. Elements, for example made from expanded polystyrene, are used to shim the object. The object is for example placed in a protective bag.

To open the packaging, a user removes the cover from the box or opens the flaps of the carton. He then grasps the object, generally using both hands, and moves it upward to ultimately place it on a receiving surface. He next removes the bag.

In general, before opening, the packaging is placed on a surface situated lower than the receiving surface, in order to facilitate the removal movement of the object. Nevertheless, the object typically having a mass comprised between 2 and 25 kg, the removal movement remains difficult for the user to perform.

SUMMARY

One aim of the invention is to provide packaging as described above that makes the unwrapping operation easier.

To that end, the invention relates to a packaging of the type described above, in which:

- the body also comprises a base intended to serve as a support for the object in the open configuration of the body, the base defining at least one portion of the lower face in the closed configuration of the body; and
- at least one of said parts of the body is situated away from the base in the open configuration to arrange direct access to the object in at least one access direction substantially perpendicular to the bearing direction, the direct access being intended to allow said removal of the object.

According to specific embodiments, the assembly comprises one or more of the following features, considered alone or according to all technically possible combinations:

- the body is configured so that the passage from the closed configuration to the open configuration is done by moving one of the two parts of the body relative to the other along a trajectory substantially perpendicular to the bearing direction;
- the two parts of the body are situated away from the base in the open configuration of the body, the base being separate from each of the two parts and intended to form a pedestal for the object in the open configuration;
- said parts of the body define, in the closed configuration, an opening of the housing toward the outside of the body, the base extending through the opening, and the opening being defined by an edge including at least one shoulder able to cooperate with at least one complementary shoulder of the base to prevent unboxing of the base in the bearing direction;
- the body forms a generally prismatic box, preferably parallelepiped, in the closed configuration;
- the member for fixing the two parts together in the closed configuration comprises a cartridge suitable for being slid on the body;
- one of the two parts is mounted rotatably relative to the other of the two parts around an axis, the axis preferably being substantially parallel to the bearing direction;
- the base is situated completely inside the housing seen in the bearing direction;
- each of the two parts of the body comprises an outer layer preferably made from cardboard, a wedging block comprising a cellular or foam structure, and advantageously an inner shell intended to substantially fit the object and prevent scratches from appearing on the object during the transport of the object in the packaging; and
- the base defines a storage housing emerging, in the closed configuration, in the housing defined by said two parts of the body to receive the object, the storage housing being intended preferably to receive a power cord of the object.

BRIEF DESCRIPTION OF THE DRAWINGS

The invention also relates to an assembly of at least one object, preferably a speaker enclosure or amplifier, and a packaging as described above, the body of the packaging being:

- in the closed configuration, the object being received in the housing defined by the two parts, or
- in the open configuration, the object resting on the base.

Figures 1, 2:
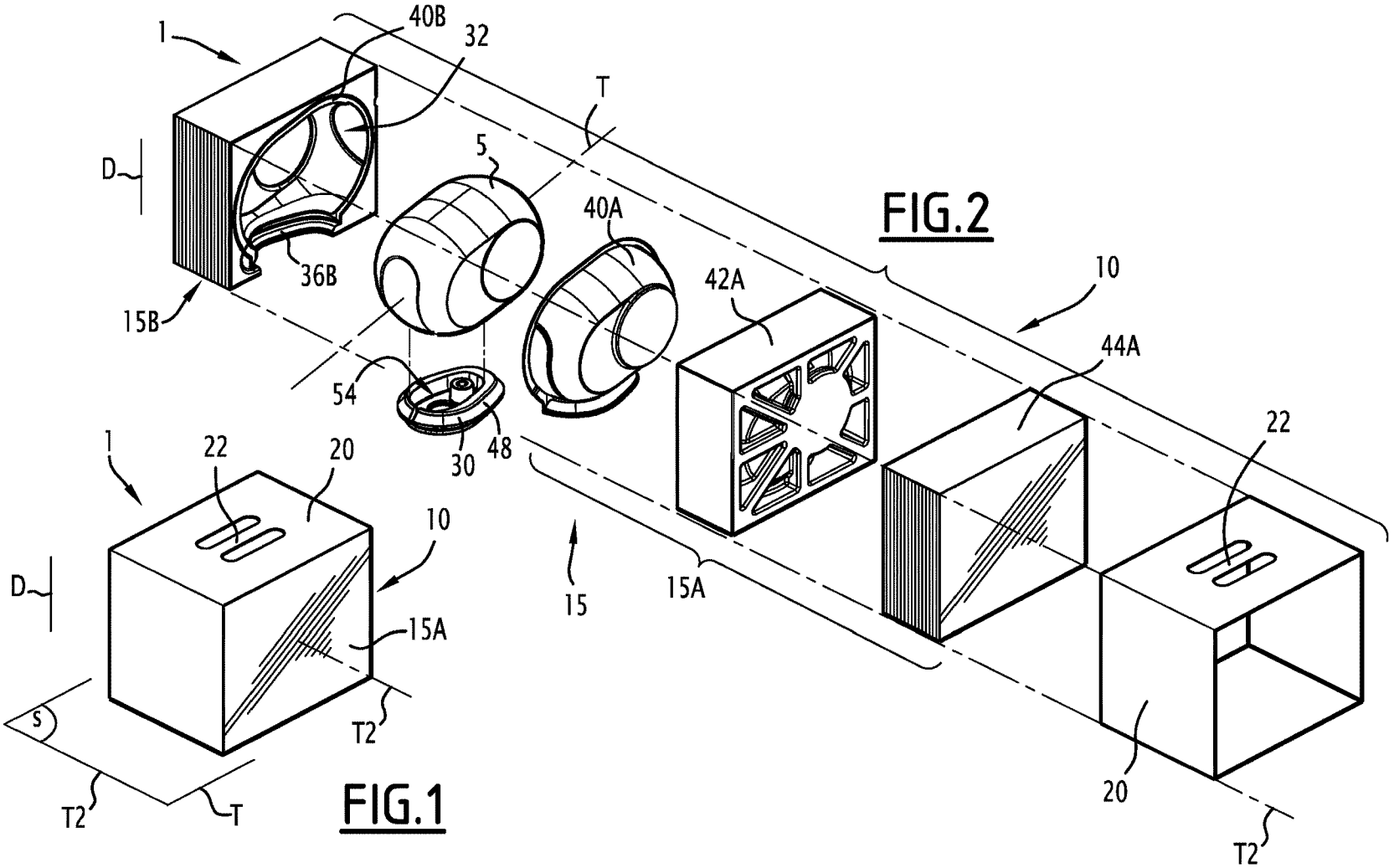
Figure 3:
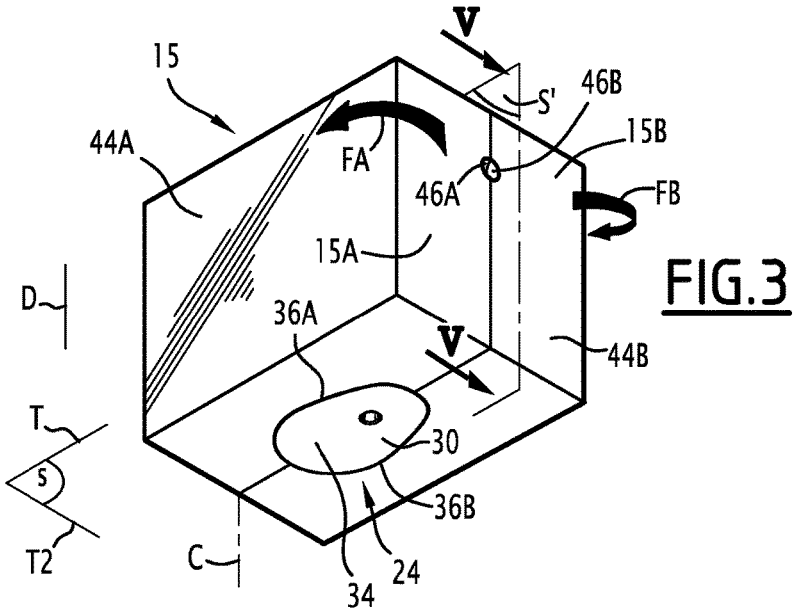
Figure 5:
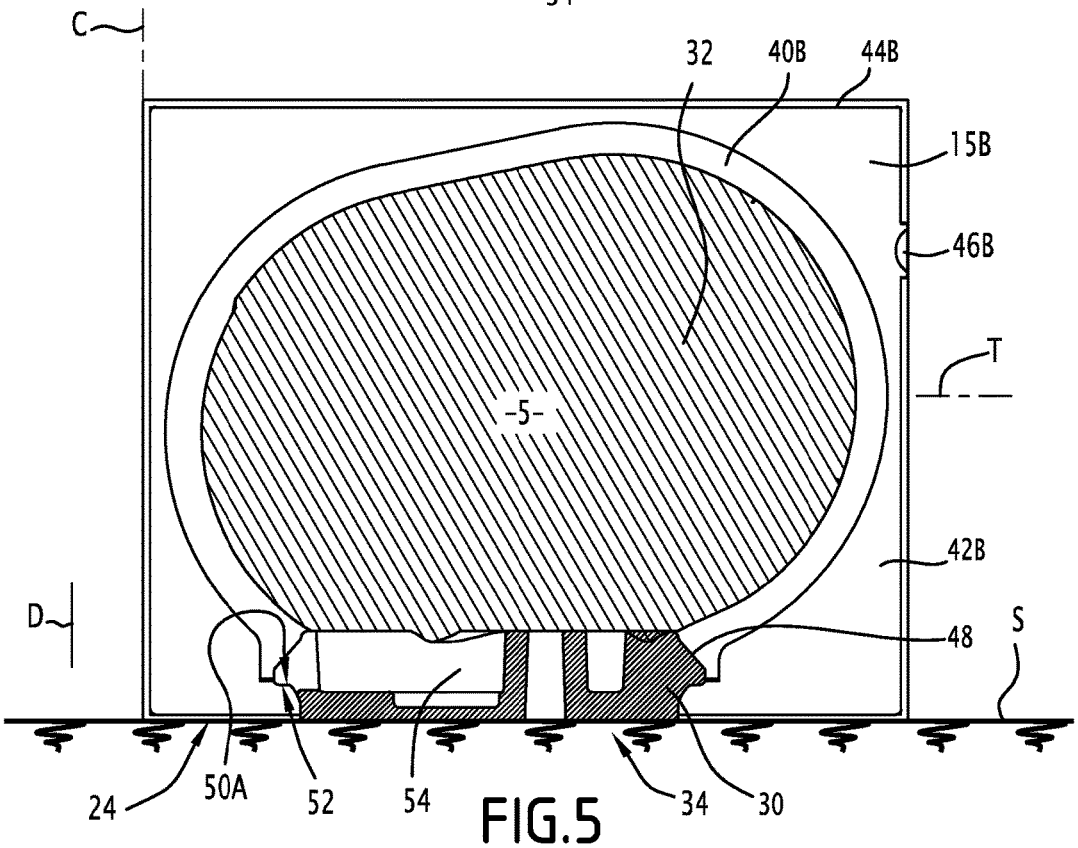
Figure 4:
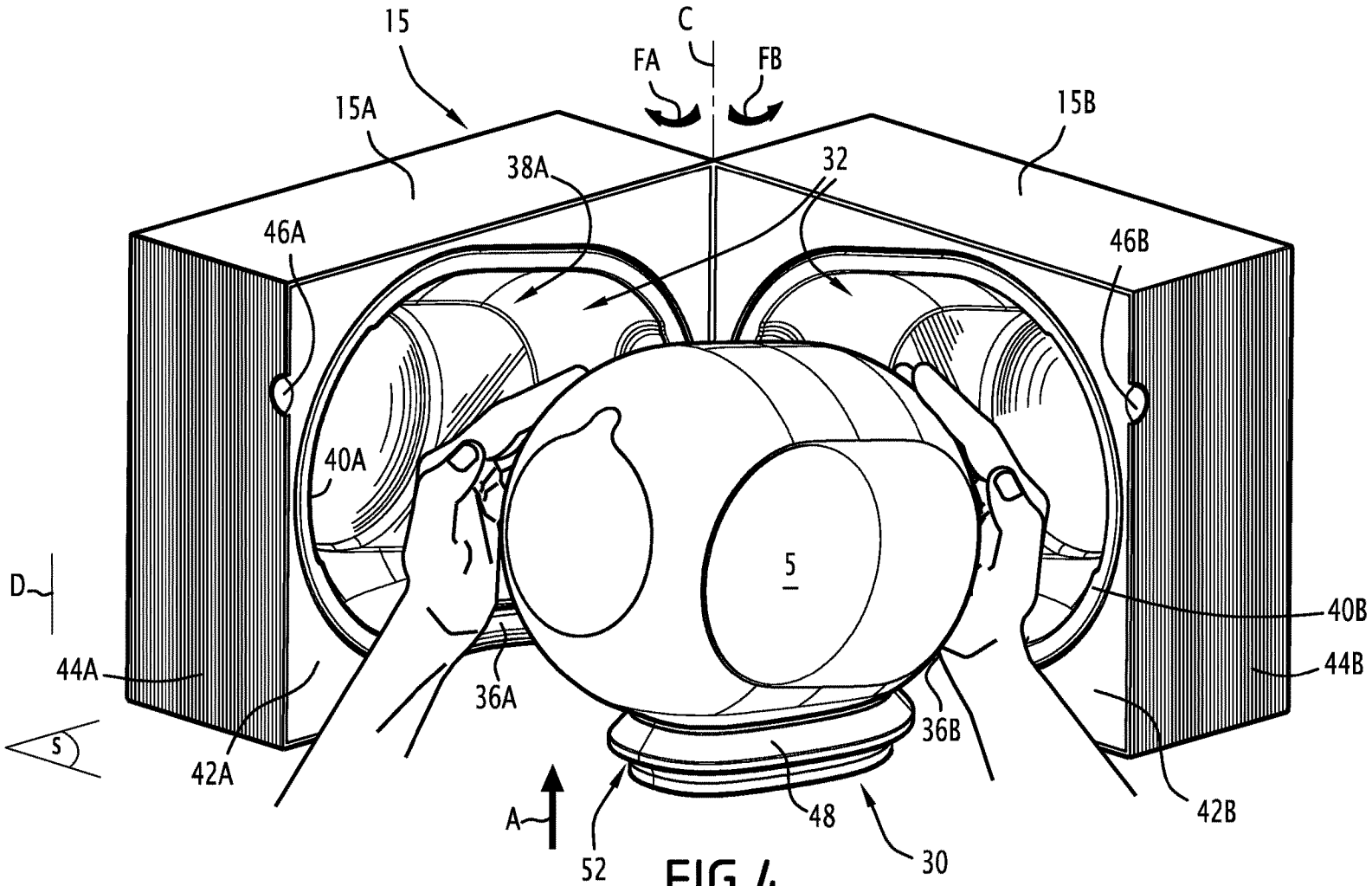

The invention will be better understood upon reading the following description, provided solely as an example, and in reference to the appended drawings, in which:

FIG. 1 is a perspective view of an assembly according to the invention, the body being in the closed configuration and protected by a cartridge fixing the two parts of the body together, FIG. 2 is an exploded view of the assembly shown in FIG. 1 in a direction substantially perpendicular to the bearing direction, FIG. 3 is a perspective view of the body of the packaging shown in FIGS. 1 and 2, the view being taken from an angle showing the lower face of the body, FIG. 4 is a perspective view of the body and the object shown in FIGS. 1 to 3, the body being in the open configuration and the object resting on the base, and FIG. 5 is a sectional view of the body and the object shown in FIGS. 1 to 4, in a plane of symmetry of the two parts of the body in the closed configuration.

DETAILED DESCRIPTION

An assembly 1 according to the invention is described in reference to FIGS. 1 to 5.

As shown in FIG. 1, the assembly 1 advantageously has a parallelepiped shape. The assembly 1 rests on the surface S, for example substantially planar and advantageously substantially horizontal, in a bearing direction D substantially perpendicular to the surface S, i.e., substantially vertical in the case at hand.

According to an alternative that is not shown, the surface S forms an angle with the horizontal and the bearing direction D is therefore not vertical.

In reference to FIGS. 2, 3 and 4, the assembly 1 comprises an object 5 and packaging 10 suitable for wrapping and unwrapping the object 5.

The object 5 is for example a speaker enclosure. In the illustrated example, the object 5 has a globular general shape, slightly oblong in a direction T (FIG. 2) substantially perpendicular to the bearing direction D.

Alternatively, the object 5 has any general shape, irrespective of whether it is typical, for a speaker enclosure.

The object 5 for example has a mass comprised between 2 and 25 kg.

According to one alternative that is not shown, the object 5 is any object in the consumer acoustics or electronics field, for example an amplifier. The packaging 10 comprises a body 15 including at least two parts 15A, 15B, etc., and movable between a closed configuration shown in FIG. 3, and an open configuration shown in FIG. 4.

The packaging 10 further comprises a member 20 (FIGS. 1 and 2) suitable for fixing the two parts 15A, 15B together in the closed configuration of the body 15.

The member 20 for example forms a cartridge suitable for being slid on the body 15 in a direction T2 when the body 15 is in the closed configuration. The member 20 for example includes four faces suitable for encircling the body 15 around the direction T2.

The member 20 for example includes a handle 22 on one of the faces, suitable for allowing the assembly 1 to be transported like a suitcase.

The member 20 is for example made from printed cardboard or from plastic. The direction T2 is for example substantially perpendicular to the bearing direction D.

The body 15 for example has a substantially parallelepiped general shape, advantageously suitable for cooperating with the member 20. In the closed configuration (FIG. 3), the body 15 defines a lower face 24 intended to rest on the surface S in the bearing direction D when the member 20 is removed.

Aside from the two parts 15A, 15B, the body 15 comprises a base 30 able to support the object 5 in the open configuration of the body (FIG. 4).

In the closed configuration (FIG. 3), the body defines a housing 32 suitable for receiving the object 5.

The body 15 is advantageously configured so that the passage from the closed configuration (FIG. 3) to the open configuration (FIG. 4) is done by the parts 15A, 15B relative to the other along a trajectory substantially perpendicular to the bearing direction D.

Advantageously, the housing 32 substantially marries the outer shape of the object 5.

In the closed configuration, the parts 15A, 15B are in contact with one another in a plane S' (FIG. 3) parallel to the bearing direction D.

According to one alternative that is not shown, the parts 15A, 15B are in contact with one another in the closed configuration along any surface.

Still in the closed configuration, the parts 15A, 15B define an opening 34 of the housing 32 toward the outside of the body 15 through which the base 30 extends.

Each part 15A, 15B comprises an edge 36A, 36B defining the opening 34.

In the open configuration, the parts 15A, 15B are separated from one another relative to the closed configuration to allow the object 5 to be removed from the housing 32. The parts 15A, 15B are situated away from the base 30 to arrange direct access to the object 5 in an access direction A (FIG. 4) substantially perpendicular to the bearing direction D.

In the illustrated example, the part 15B is mounted pivoting on the part 15A around an axis C advantageously substantially parallel to the bearing direction D.

In the illustrated example, the parts 15A, 15B are substantially symmetrical to one another relative to the plane S'; therefore, only the part 15A will be described in detail below.

As shown in FIG. 4, the part 15A has a substantially parallelepiped general shape. On the side of the face intended to be in contact with the part 15B in the closed configuration of the body 15, the part 15A defines a housing 38A that represents half of the housing 32 in the described example.

As shown in FIG. 2, the part 15A successively comprises, from the inside of the body 15 toward the outside, an inner shell 40A, a wedging block 42A, and an outer layer 44A.

Furthermore, the part 15A advantageously includes a notch 46A configured to facilitate the opening of the body 15 in cooperation with a symmetrical notch 46B of the part 15B.

The inner shell 40A substantially fits the object 5 and a peripheral edge 48 of the base 30. The inner shell 40A is for example made from polystyrene, advantageously from sweetylene, or acrylonitrile butadiene styrene (or ABS), or is made from any other material suitable for preventing scratches from appearing on the object 5 and/or participating in protecting against impacts or the intrusion of contusive objects in the wedging block 42A.

The wedging block 42A is a cellular or foam structure suitable for receiving the shell 40A on one side, for example in the direction T2, and for nesting in the outer layer 44A on the other side.

The edge 36A defines a shoulder 50A suitable for cooperating with a shoulder 52 of the peripheral edge 48 of the base 30 so as to prevent unboxing of the base in the bearing direction D.

The base 30 defines part of the lower face 24 (FIG. 3) of the body 15. In the illustrated example, the base 30 is separate from the two parts 15A, 15B.

The base 30 is suitable for resting on the surface S and bearing all of the weight of the object 5 when the body 15 is in the open configuration (FIG. 4).

The base 30 advantageously forms a pedestal for the object 5 in the open configuration. For example, seen in the bearing direction D, the base 30 is situated completely inside the housing 32.

The base 30 defines a storage housing 54 for example able to receive a power cord (not shown) for the object 5.

The operation of the packaging 10 is easily deduced from its structure and will now be described.

In the packaged state, the object 5 assumes the form of the assembly 1 shown in FIG. 1. The assembly 1 is for example placed on the surface S, which is advantageously the upper surface of a table or display.

To unwrap the object 5, the member 20 is first removed. For example, the body 15, which is in the closed configuration, is slid relative to the member 20 in direction T2. One then obtains the body 15 as shown in FIG. 3, the object 5 being in the housing 32 inside the body 15.

The lower face 24 of the body 15 then rests on the surface S.

Secondly, an operator (not shown) takes the body 15 from the closed configuration shown in FIG. 3 to the open configuration shown in FIG. 4. The operator pivots the parts 15A, 15B relative to one another around the axis C.

The two parts 15A, 15B then move relative to one another along a trajectory substantially perpendicular to the bearing direction D. More specifically, they pivot around the axis C along the arrows FA and FB shown in FIGS. 3 and 4. The lower faces of the parts 15A, 15B slide on the surface S and free the base 30 and the object 5.

The object 5 then rests "majestically" on the base 30, which forms a pedestal for the object.

It is then possible for the operator to grasp the object 5 in the access direction A shown in FIG. 4 and remove it from the base 30 so as optionally to place elsewhere.

The handle 22 allows the assembly 1 to be moved easily.

In the closed configuration, the base 30 acts as a bottom and is not unboxed owing to the shoulders 50A, 52.

To package the object 5, the reverse operations are performed. The base 30 is placed on the surface S. The object 5 is placed on the base 30.

The parts 15A, 15B are brought close together and closed so as to surround the object 5 and the base 30, until the closed configuration of the body 15 is obtained.

The member 20 is next replaced such that it secures the two parts 15A, 15B in the closed configuration. The assembly 1 is again easy to transport.

Owing to the above features, the packaging 10 makes the unwrapping operations of the object 5 easy, as well as any rewrapping thereof.

Furthermore, in the open configuration of the body 15, the packaging 10 makes it possible to make the object 5 visible to everyone, the object resting on the base 30.

The invention claimed is:

1. A packaging suitable for at least one object, the packaging comprising:

a body having at least two parts, which is able to be moved between a closed configuration, in which the body defines a housing suitable for receiving the at least one object, and an open configuration, in which the two parts are separated from one another relative to the closed configuration to allow the at least one object to be removed from said housing, the body defining, in the closed configuration, a lower face intended to rest on a surface in a bearing direction; and a member for fixing the at least two parts together in the closed configuration;

wherein:

the body also comprises a base intended to serve as a support for the at least one object in the open configuration of the body, the base defining at least one portion of the lower face in the closed configuration of the body;

at least one of said parts of the body is situated away from the base in the open configuration to arrange direct access to the at least one object in at least one access direction perpendicular to the bearing direction, the direct access being intended to allow the removal of the at least one object, wherein said parts of the body define, in the closed configuration, an opening of the housing toward the outside of the body, the base extending through the opening, and the opening being defined by an edge including at least one shoulder able to cooperate with at least one complementary shoulder of the base to prevent unboxing of the base in the bearing direction.

2. The packaging according to claim 1, wherein the body is configured so that a passage from the closed configuration to the open configuration is done by moving one of the at least two parts of the body relative to the other along a trajectory perpendicular to the bearing direction.

3. The packaging according to claim 1, wherein the at least two parts of the body are situated away from the base in the open configuration of the body, the base being separate from each of the at least two parts and intended to form a pedestal for the at least one object in the open configuration.

4. The packaging according to claim 1, wherein the body forms a prismatic box in the closed configuration.

5. The packaging according to claim 4, wherein the member for fixing the at least two parts together in the closed configuration comprises a cartridge suitable for being slid on the body.

6. The packaging according to claim 4, wherein the body forms a parallelepiped.

7. The packaging according to claim 1, wherein the at least two parts are rotatable relative to each other around an axis.

8. The packaging according to claim 7, wherein the axis is parallel to the bearing direction.

9. The packaging according to claim 1, wherein the base is situated completely inside the housing seen in the bearing direction.

10. The packaging according to claim 1, wherein each of the at least two parts of the body comprises an outer layer, and a wedging block comprising a cellular or foam structure.

11. The packaging according to claim 10, wherein the outer layer is made from cardboard.

12. The packaging according to claim 10, wherein each of the at least two parts further comprises an inner shell intended to fit the at least one object and prevent the scratches from appearing during the transport of the at least one object in the packaging.

13. The packaging according to claim 1, wherein the base defines a storage housing emerging, in the closed configuration, in the housing defined by said at least two parts of the body to receive the at least one object.

14. The packaging according to claim 13, wherein the storage housing is intended to receive a power cord of the at least one object.

15. The packaging according to claim 1, wherein the at least one object has a mass comprised between 2 and 25 kg.

16. An assembly of at least one at least one object and a packaging according to claim 1, the body of the packaging being:

in the closed configuration, the at least one object being received in the housing defined by the at least two parts, or in the open configuration, the at least one object resting on the base.

17. The assembly according to claim 16, wherein the at least one object is a speaker enclosure or an amplifier.

* * * * *